US011733629B2

(12) United States Patent
Sano et al.

(10) Patent No.: US 11,733,629 B2
(45) Date of Patent: Aug. 22, 2023

(54) FIXING DEVICE

(71) Applicant: CANON KABUSHIKI KAISHA, Tokyo (JP)

(72) Inventors: Tetsuya Sano, Shizuoka (JP); Michio Uchida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/829,076

(22) Filed: May 31, 2022

(65) Prior Publication Data

US 2022/0390883 A1 Dec. 8, 2022

(30) Foreign Application Priority Data

Jun. 7, 2021 (JP) ..... 2021-094998

(51) Int. Cl.
*G03G 15/20* (2006.01)

(52) U.S. Cl.
CPC ..... *G03G 15/2057* (2013.01); *G03G 15/2028* (2013.01)

(58) Field of Classification Search
CPC ..... G03G 15/2028; G03G 15/2057
See application file for complete search history.

(56) References Cited

U.S. PATENT DOCUMENTS

2008/0219723 A1* 9/2008 Lee ..... G03G 15/2064 399/329

FOREIGN PATENT DOCUMENTS

| | | |
|---|---|---|
| JP | 2012-118339 A | 6/2012 |
| JP | 2013-160939 A | 8/2013 |
| JP | 2014-026267 A | 2/2014 |

* cited by examiner

*Primary Examiner* — Victor Verbitsky
(74) *Attorney, Agent, or Firm* — Canon U.S.A., Inc., I.P. Division

(57) ABSTRACT

A fixing device to fix a toner image formed on a recording medium to the recording medium includes a rotating member, a guide member, a holding member, and a roller. The roller contacts with an outer surface of the rotating member and forms a fixing nip portion together with the guide member between the rotating member and the roller. The fixing device fixes the recording medium toner image to the recording medium while pinching and conveying the recording medium in the fixing nip portion. The guide member is pivotable relative to the holding member about a pivot point that is a shaft substantially perpendicular to a surface of the fixing nip portion. When the rotating member slides on the guide member, the guide member pivots due to a force received from the rotating member so that alignment of the guide member with respect to the holding member is corrected.

15 Claims, 8 Drawing Sheets

FIXING DEVICE

BACKGROUND

Field

The present disclosure relates to a fixing device mounted in an image forming apparatus, such as an electrophotographic copying machine or an electrophotographic printer.

Description of the Related Art

As a fixing device mounted in an electrophotographic copying machine or an electrophotographic printer, a fixing device has been developed that fixes a toner image formed on a recording medium at a fixing nip portion formed between a cylindrical film and a roller (refer to Japanese Patent Laid-Open No. 2014-26267).

If the alignment of the film is deviated due to the accuracy of dimension of a part and the accuracy of assembly at the time of assembly, the stable rotation of the film is not achieved. When the rotation stability of the film is decreased, the recording medium conveyance performance is deteriorated and, thus, a recording medium may be wrinkled, or an image defect, such as deterioration of the fixability of the toner image, may occur.

SUMMARY

The present disclosure provides a fixing device including a film that rotates stably.

According to an aspect of the present disclosure, a fixing device configured to fix a toner image formed on a recording medium to the recording medium includes a rotating member that is flexible and cylindrical, a guide member disposed in an internal space of the rotating member throughout a length of the rotating member in a longitudinal direction of the rotating member so as to be in contact with an inner surface of the rotating member and configured to guide rotation of the rotating member, a holding member disposed in the internal space of the rotating member throughout the length of the rotating member in the longitudinal direction of the rotating member and configured to hold the guide member throughout a length of the guide member in the longitudinal direction, and a roller configured to contact with an outer surface of the rotating member and to form a fixing nip portion together with the guide member between the rotating member and the roller, wherein the fixing device fixes the toner image formed on the recording medium to the recording medium while pinching and conveying the recording medium in the fixing nip portion, wherein the guide member is pivotable relative to the holding member about a pivot point that is a shaft substantially perpendicular to a surface of the fixing nip portion, and wherein, when the rotating member slides on the guide member, the guide member pivots due to a force received from the rotating member so that alignment of the guide member with respect to the holding member is corrected.

Further features of the present disclosure will become apparent from the following description of exemplary embodiments with reference to the attached drawings.

DESCRIPTION OF THE EMBODIMENTS

First Embodiment

Configuration of Fixing Device

Figure 1:
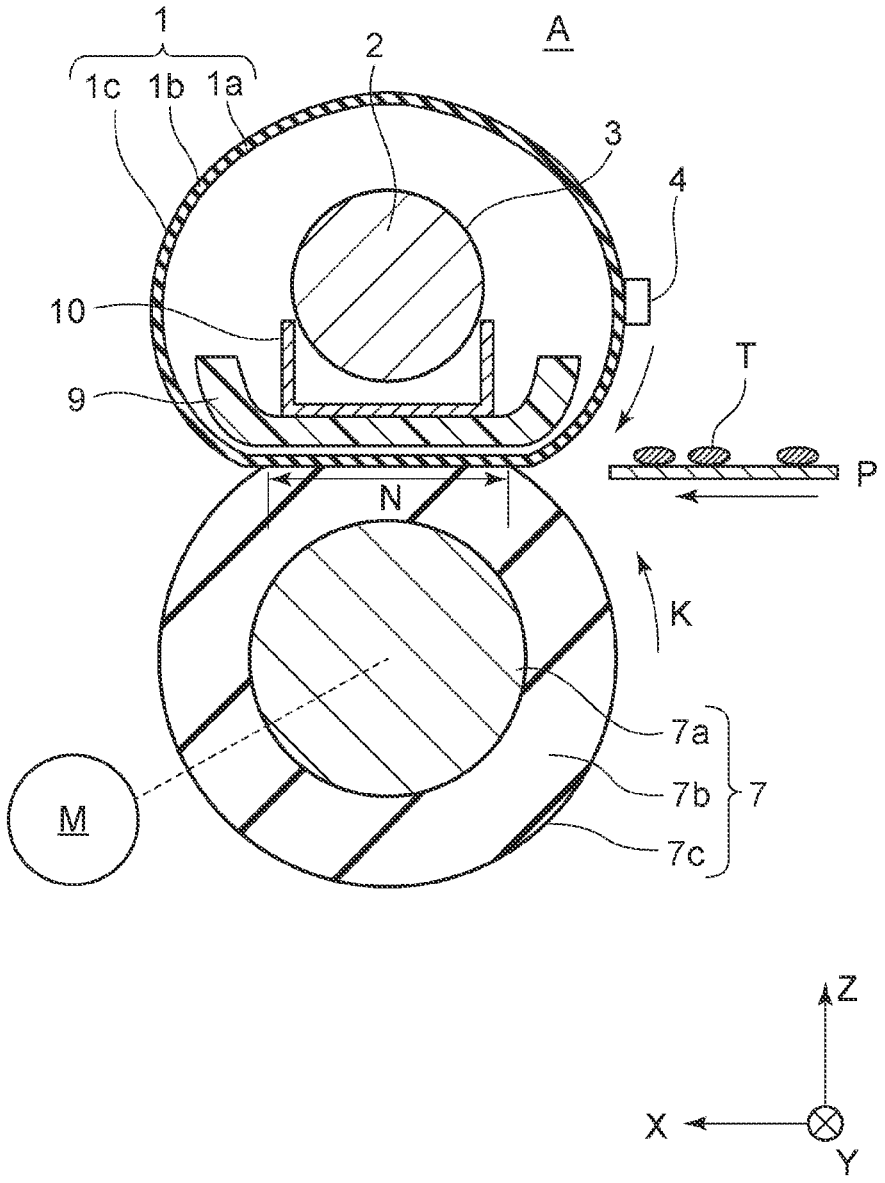
FIG. 1 is a cross-sectional view of a fixing device according to a first embodiment.
Figure 2:
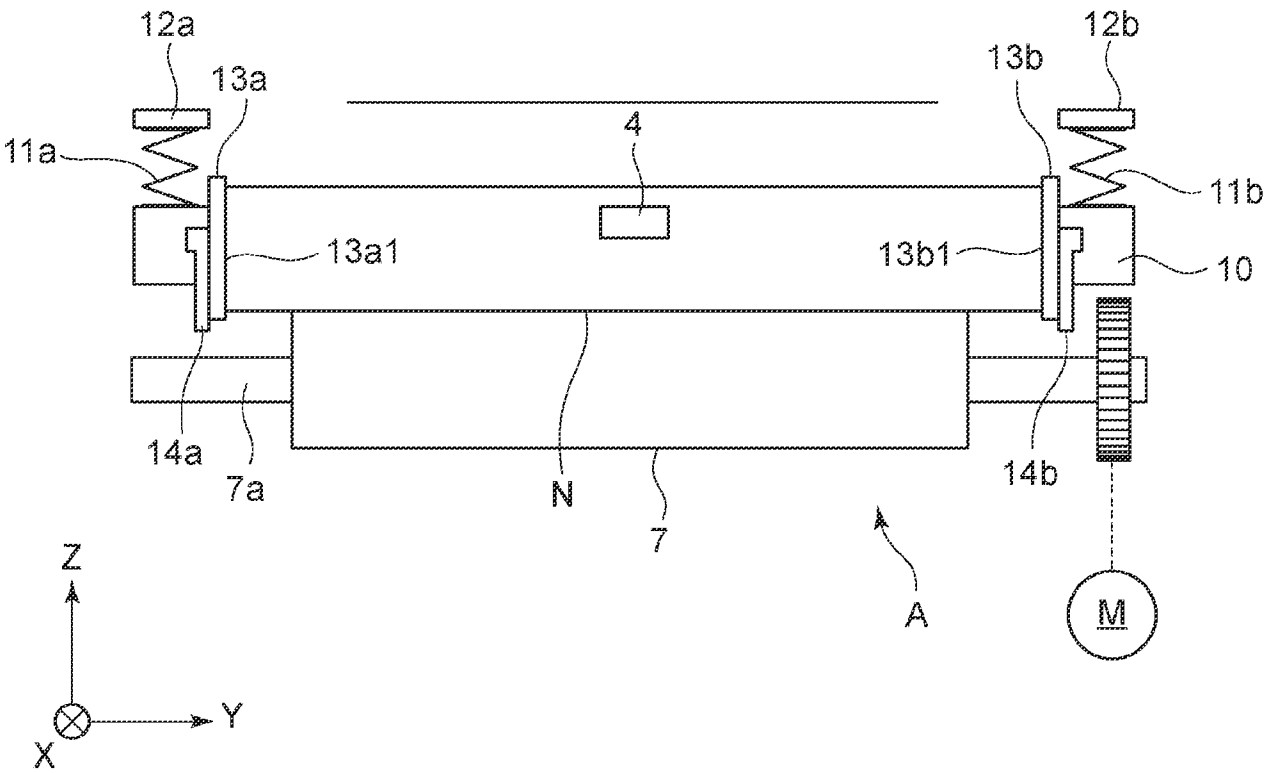
FIG. 2 is a front view of the fixing device according to the first embodiment.

A fixing device A according to the first embodiment is described with reference to FIGS. 1 and 2. The fixing device A is mounted in an image forming apparatus (not illustrated), such as an electrophotographic copying machine or an electrophotographic printer. The fixing device A heats a toner image T formed on a recording medium P and fixes the toner image T onto the recording medium P. FIG. 1 is a cross-sectional view of the fixing device A, and FIG. 2 is a front view of the fixing device A as viewed from the upstream side in a conveyance direction X of the recording medium P.

The fixing device A includes a cylindrical fixing film (a flexible rotating member) 1 that is rotatably supported and a guide (a guide member) 9 that is made of a heat-resistant resin and that guides the rotation of the film. The fixing device A further includes a metal stay (a holding member) 10 that reinforces the guide 9 and a pressure roller 7 that forms a fixing nip portion N together with the guide 9 via the fixing film 1. The fixing device A fixes, onto the recording medium P, the toner image T formed on the recording medium P while pinching and conveying the recording medium P by the fixing nip portion N.

The material of the guide 9 is PPS (polyphenylene sulfide). The guide 9 is disposed in the internal space of the fixing film 1 so as to extend throughout the length of the fixing film 1 in the longitudinal direction of the fixing film 1 (the Y-axis direction). In addition, the stay 10 is also disposed in the internal space of the fixing film 1 so as to extend throughout the length of the fixing film 1 in the longitudinal direction of the fixing film 1. Thus, the stay 10 reinforces the guide 9 throughout the length of the guide 9 in the longitudinal direction of the fixing film 1. In addition, a magnetic core 2 having an energizing coil 3 wound therearound is disposed in the internal space of the fixing film 1. The magnetic core 2 has substantially the same length as the film 1 in the Y-axis direction, and the magnetic core 2 has an ended shape. The fixing device A is of an induction heating type in which the fixing film 1 generates heat by electromagnetic induction.

The pressure roller (a roller) 7 includes a core metal 7*a*, a rubber layer 7*b*, and a release layer 7*c*. The diameter of the pressure roller 7 is 30 mm. It is desirable that the rubber layer 7*b* be made of a material having excellent heat resistance, such as silicone rubber or fluororubber, and it is desirable that the release layer 7*c* be made of a material having excellent releasability and heat resistance, such as PFA (tetrafluoroethylene-perfluoroalkyl vinyl ether copolymer) or PTFE (polytetrafluoroethylene). Both ends of the core metal 7*a* in a direction (the Y-axis direction) perpendicular to the conveyance direction (the X-axis direction) of the recording medium P, that is, in the axial direction of the pressure roller 7, are rotatably supported by right and left side plate frames (not illustrated) of the fixing device A via bearings.

The fixing film 1 includes a heat generating layer (a base layer) la having a diameter of 10 to 50 mm, a rubber layer 1*b*, and a release layer 1*c*. It is desirable that the heat generating layer 1*a* be a metal layer having a low volume resistivity. According to the present embodiment, SUS (stainless steel) having a thickness of 20 μm to 100 μm is used. Note that as described in more detail below, the fixing device A is configured so as to form a magnetic path having a shape such that most (90% or more) of the magnetic flux emitted from one end of the magnetic core 2 in the Y-axis direction to the outside of the fixing film 1 passes outside of the fixing film 1 and returns to the other end of the magnetic core 2. Therefore, since the fixing device A is not of a type of device that induces the magnetic flux into the inside of the heat generating layer 1*a* (that is, the region of the thickness) to generate heat of the heat generating layer, a magnetic metal or a non-magnetic metal can be used as the material of the heat generating layer 1*a*. The material of the rubber layer 1*b* is a silicone rubber having a hardness of 20 degrees (JIS (a), load: 1 kg) and a thickness of 0.1 mm to 0.3 mm. The release layer 1*c* is a fluororesin tube having a thickness of 10 μm to 50 μm.

As illustrated in FIG. 2, flanges 13*a* and 13*b* made of heat-resistant resin are provided at either end of the stay 10 in the Y-axis direction (the longitudinal direction of the fixing device A). Each of the flanges 13*a* and 13*b* holds the inner peripheral surface (the inner surface) of an end portion of the film 1 by a holding portion (not illustrated) inserted into the hollow portion of the film 1. In addition, the flanges 13*a* and 13*b* have regulating surfaces 13*a*1 and 13*b*1, respectively, which receive the end surfaces of the film 1 when the rotating film 1 laterally shifts in the Y-axis direction. The lateral shift of the film 1 in the Y-axis direction is regulated by the regulating surfaces 13*a*1 and 13*b*1. As described below, a predetermined gap is formed between the guide 9 and the flange 13 and between the guide 9 and the stay 10 in each of the X-axis and Y-axis directions so that the guide 9 can pivot about a pivot point.

The left and right side plate frames (not illustrated) of the fixing device A include spring bearing members 12*a* and 12*b*, respectively. Pressurizing springs (compression springs) 11*a* and 11*b* are provided between one end of the stay 10 in the Y-axis direction and the spring bearing member 12*a* and between the other end and the spring bearing member 12*b*, respectively. In this manner, a pressing force is exerted on the stay 10. In the fixing device A according to the present embodiment, the pressing force of about 100 N to 450 N (about 10 kgf to about 45 kgf) in total is applied to the stay 10. The pressing force causes the guide 9 to be pressed toward the pressure roller via the film 1 and, thus, the fixing nip portion N is formed. The pressure roller 7 is driven in the direction of arrow K (refer to FIG. 1) by the power of a motor M. The film 1 rotates following the rotation of the pressure roller 7 while the inner surface of the fixing film 1 is sliding on a surface of the guide 9. Note that a temperature detection element 4 illustrated in FIG. 2 detects the temperature of the film 1.

Figure 3A:
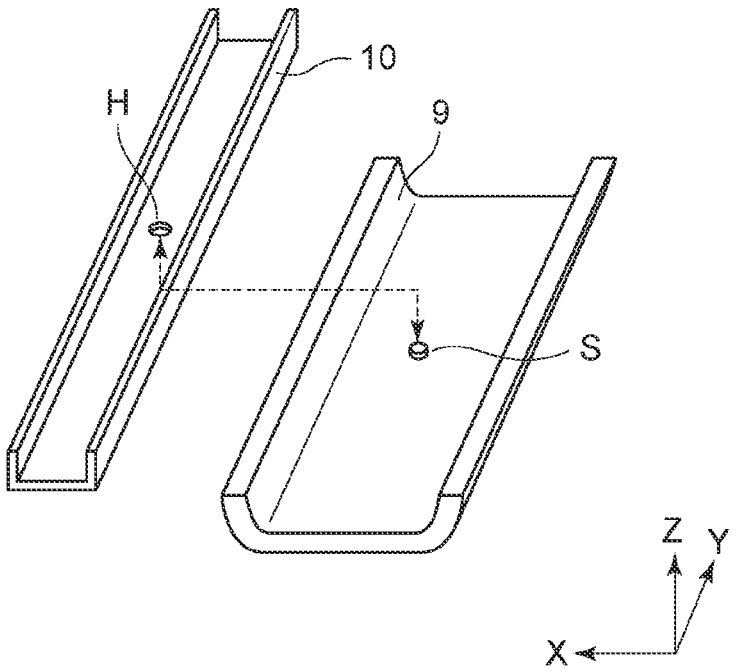
FIGS. 3A and 3B are schematic illustrations of a guide and a stay.
Figure 3B:
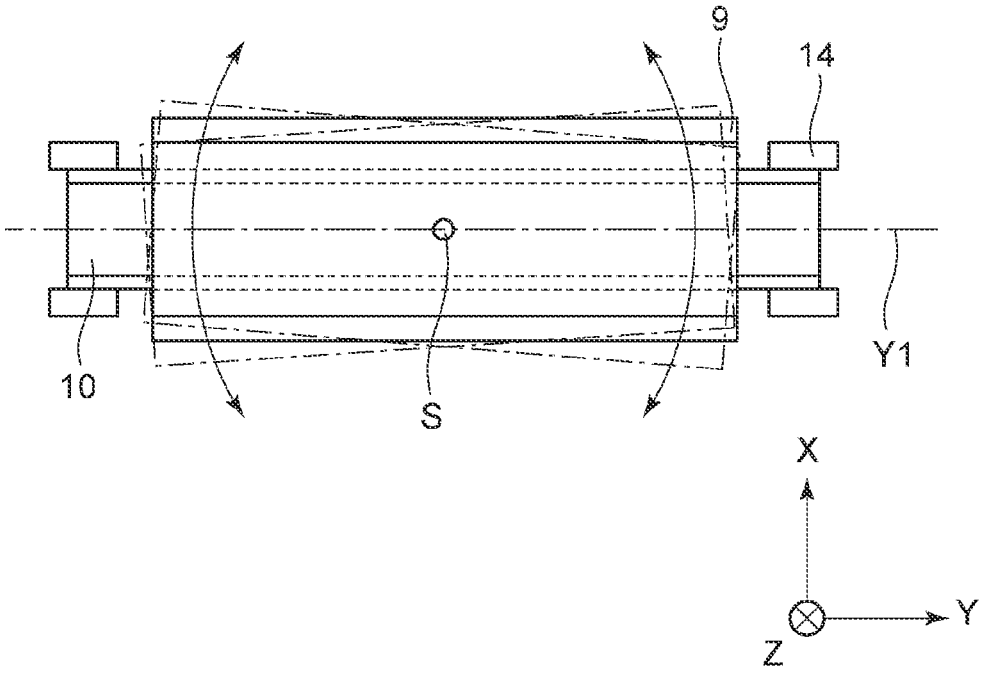

FIGS. 3A and 3B illustrate the configurations of the stay 10 and the guide 9. FIG. 3A is a perspective view illustrating the relationship between the guide 9 and the stay 10, and FIG. 3B is a schematic illustration of the stay 10 and the guide 9 as viewed in the Z-axis direction. As illustrated in FIGS. 3A and 3B, the guide 9 includes a protrusion S at a position of the central part in the Y-axis and X-axis directions. The stay 10 has an opening H for supporting the guide 9 at a position facing the protrusion of the guide 9. The protrusion S of the guide 9 is inserted into the opening H so as to penetrate the opening H of the stay 10. In addition, the lower surface of the stay 10 presses a surface of the guide 9 facing the stay 10 due to the forces of the pressurizing springs 11*a* and 11*b*. Thus, the guide 9 is pressed toward the pressure roller 7. As illustrated in FIG. 3B, the stay 10 is positioned and fixed to the side plate frame of the fixing device A by a regulating member 14 when the forces of the pressurizing springs 11*a* and 11*b* are applied. In contrast, the guide 9 is configured to be held by the stay 10 in a pivotable manner about the protrusion S in the directions of the arrows.

Figure 4:
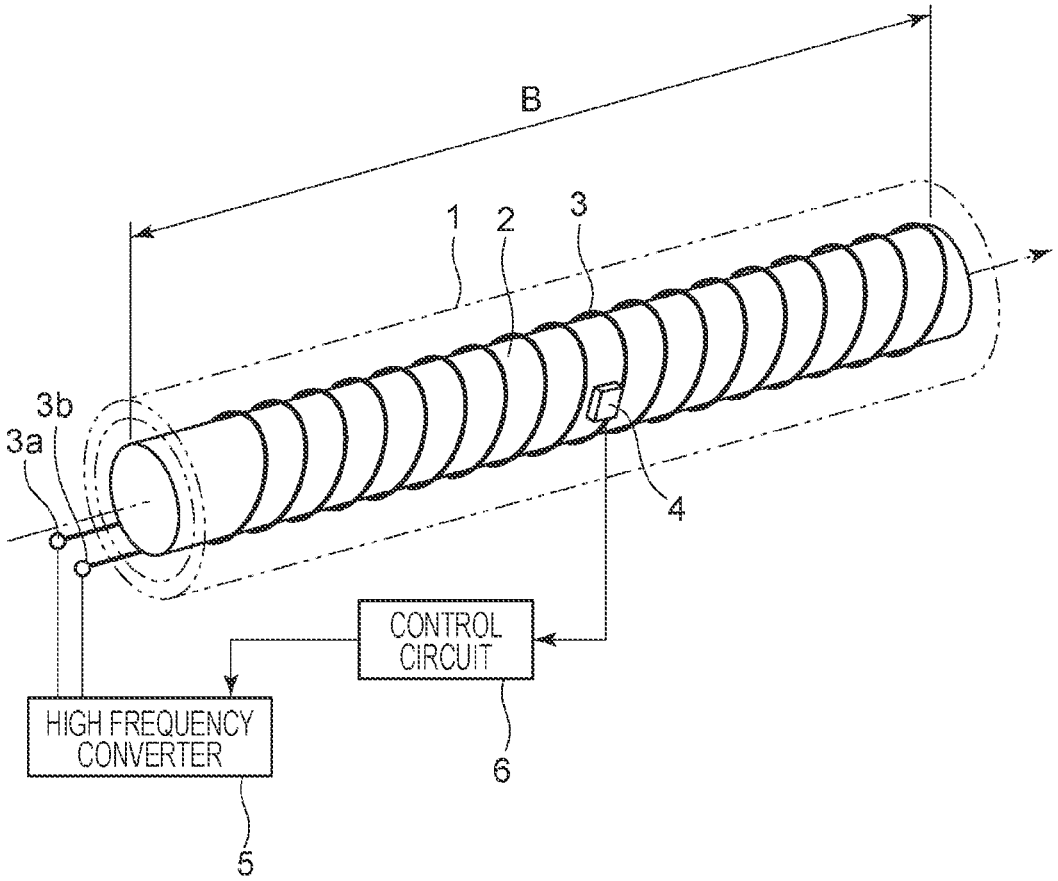
FIG. 4 illustrates the principle of heat generation.

FIG. 4 is a perspective view of the magnetic core 2 and the energizing coil 3. The magnetic core 2 has a cylindrical shape and is disposed in the substantially center of the internal space of the fixing film 1 in the radial direction of the fixing film 1 by a fixing unit (not illustrated). In the internal space of the fixing film 1, the lines of magnetic force (the magnetic flux) generated when a high-frequency current is passed through the energizing coil 3 penetrate the inside of the magnetic core 2 in the Y-axis direction. Then, a magnetic field is generated that has a shape such that the lines of magnetic force emitted from one end of the magnetic core 2 in the Y-axis direction pass through the outside of the fixing film 1 and enter the other end. A current flowing in the circumferential direction of the fixing film 1 is induced in the heat generating layer 1*a* of the fixing film 1 so as to generate a magnetic field that cancels the above-described magnetic field.

It is desirable that the material of the magnetic core 2 have a small hysteresis loss and a high relative magnetic permeability. For example, a ferromagnetic material composed of an oxide or an alloy material having a high magnetic permeability, such as a fired ferrite, a ferrite resin, an amorphous alloy, or permalloy, is desirable. In addition, it is desirable to maximize the cross-sectional area of the magnetic core 2 within the range that can be stored in the internal space of the fixing film 1, and the diameter is set to 5 mm to 40 mm. The shape of the magnetic core 2 is not limited to a cylindrical shape, and a prismatic shape or the like can be selected. According to the present embodiment, the magnetic core 2 is disposed only in the internal space of the fixing film 1 to form an open magnetic path. However, the magnetic core may be disposed outside of the fixing film 1 to form a closed magnetic path. The energizing coil 3 is formed from a single copper conductive wire that has a diameter of 1 mm to 2 mm and that is coated with heat-resistant polyamide imide. The copper wire is wound about 10 to 30 turns around a magnetic core 2 to form a spiral energizing coil 3. According to the present embodiment, the number of turns is 18.

When the image forming operation performed by the image forming apparatus is started, the fixing device A causes the fixing film 1 to generate electromagnetic induction heat at a predetermined time point and causes the motor M to start driving the pressure roller 7. The rotary force of the pressure roller 7 acts on the fixing film 1 due to the frictional force of the fixing nip portion N. Thus, the fixing film 1 enters a driven rotating state. The high frequency converter 5 supplies a high frequency current to the energizing coil 3 via feeding contact portions 3*a* and 3*b*. A control circuit 6 controls the high frequency converter 5 on the basis of the temperature detected by a temperature detection element 4 that detects the surface temperature of the fixing film 1. In this manner, the fixing device A causes the fixing film 1 to generate electromagnetic induction heat and adjusts and maintains the surface temperature of the fixing film 1 at a target temperature (about 150° C. to 200° C.).

Alignment Correction Operation Performed by Guide

Figure 5A:
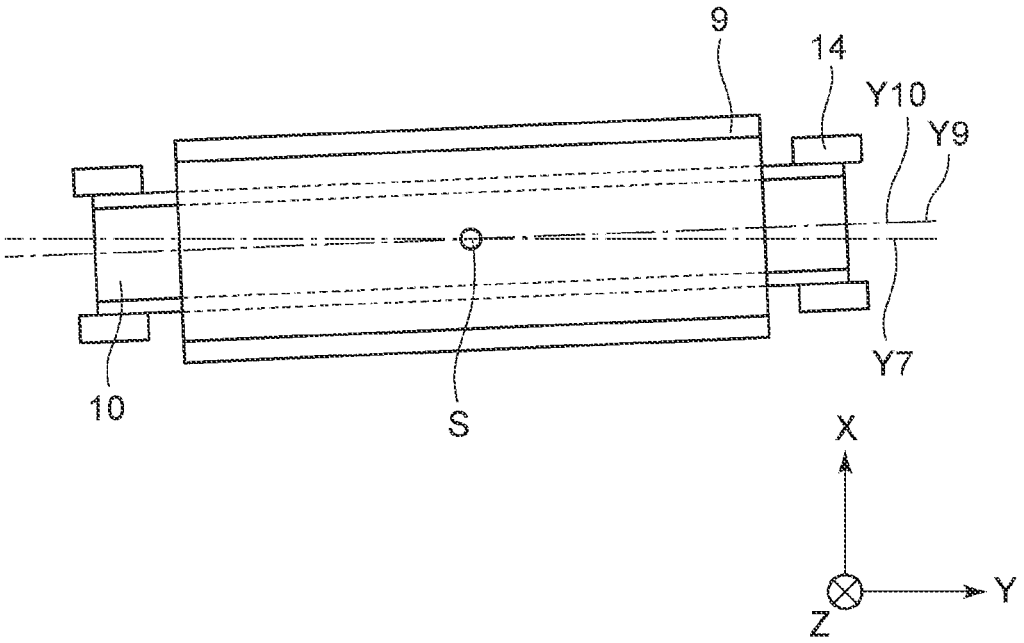
FIGS. 5A and 5B illustrate the operation performed by the guide.
Figure 5B:
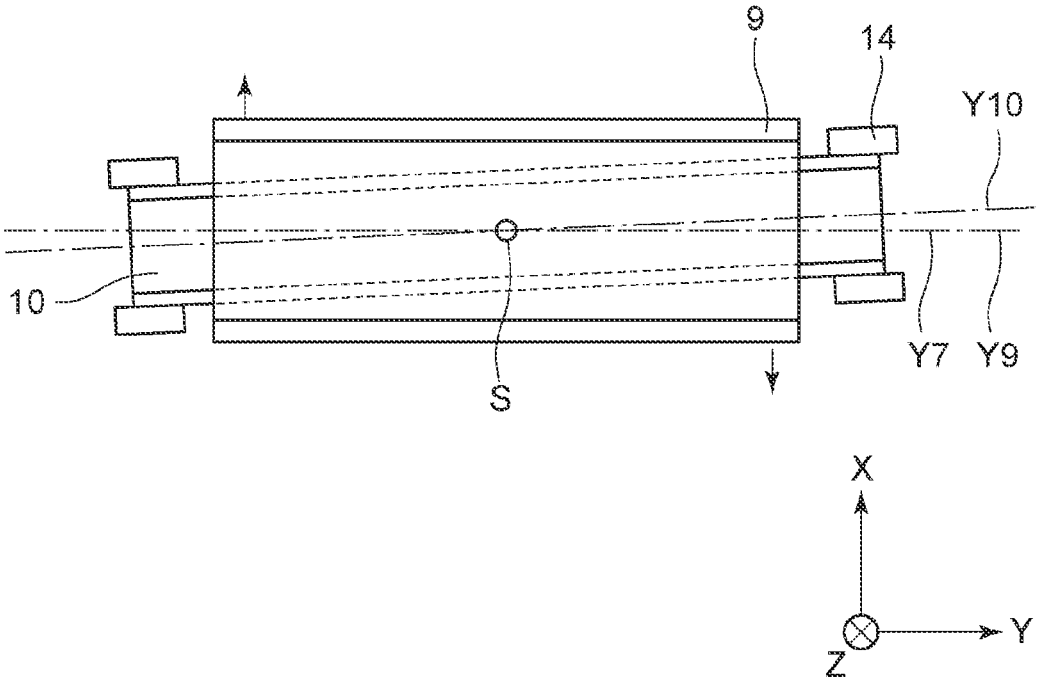

FIGS. 5A and 5B are schematic illustrations of the alignment correction operation performed by the guide 9. FIG. 5A illustrates the guide 9 and the stay 10 when a central axis Y9 of the guide 9 and a central axis Y10 of the stay 10 are deviated from an axial line Y7 of the core metal 7*a* of the pressure roller 7. FIG. 5B illustrates the guide 9 after the deviation of the central axis Y9 of the guide 9 from the axial line Y7 is corrected by pivot of the guide 9 about the protrusion S.

The case is discussed below where as illustrated in FIG. 5A, the fixing device A is assembled with the central axis Y10 of the stay 10 and the central axis Y9 of the guide 9 deviated from the axial line Y7 of the pressure roller 7 within the tolerance range due to the assembly accuracy at the time of assembling the fixing device A. When the fixing film 1 is driven to rotate by the pressure roller 7 under the condition that the central axes Y10 and Y9 are deviated from the axial line Y7 of the pressure roller 7, a force is applied to the fixing film 1 in the Y-axis direction in addition to a force in the X-axis direction which is the rotation direction of the fixing film 1. If at this time, the rotation continues, lateral shift of the fixing film 1 may occur and, thus, the end surface of the fixing film 1 may be strongly rubbed against the flange 13*a* or the flange 13*b*, decreasing the durability of the fixing film 1. Furthermore, the rotation of the fixing film 1 may be unstable, and the recording medium P may be wrinkled.

However, since the fixing device A has a configuration in which the guide 9 can pivot about the protrusion S serving as the pivot point, the guide 9 pivots due to the sliding frictional force of the fixing film 1 caused by the rotation of the fixing film 1. Thus, as illustrated in FIG. 5B, a correction is made so that the deviation between the axial line Y7 of the pressure roller 7 and the central axis Y9 of the guide 9 is eliminated. As a result, the fixing film 1 rotates stably. In addition, the force applied to the fixing film 1 in the Y-axis direction is reduced.

Table 1 indicates the evaluation result of the conveying condition for the recording medium P and an image when 100 images are continuously formed using a fixing device with deviated alignment while changing the type of the recording medium P in order to confirm the effect of the present embodiment.

Comparative Example 1 indicates the evaluation result for a fixing device in which unlike the present embodiment, the guide 9 is fixed to the stay 10 so as not to pivot. The types of recording media P that are used for evaluation include paper type A (Vitality™ available from XEROX™ Corporation, basis weight 75 g,) which is plain paper, paper type B (EcoFFICIENT™ available from HP™ Inc., basis weight 60 g,) which is thin paper, and paper type C (HP™ Brochure Paper 150 g Glossy available from HP™ Inc., basis weight 150 g) which is glossy paper. In terms of the image evaluation result in the table, "√" indicates an excellent image, and "x" indicates the occurrence of image defect, such as streaks and glossy unevenness. In terms of the conveyance performance evaluation result, "√" indicates excellent conveyance, and "x" indicates the occurrence of defect, such as paper wrinkles.

TABLE 1

| | Evaluation Result | | | |
|---|---|---|---|---|
| | First Embodiment | | Comparative Example 1 | |
| | Image Evaluation | Conveyance Performance | Image Evaluation | Conveyance Performance |
| Paper Type A | √ | √ | √ | √ |
| Paper Type B | √ | √ | × | × |
| Paper Type C | √ | √ | × | √ |

As can be seen from Table 1, for Comparative Example 1, in the case of paper type A, which is plain paper, excellent images were obtained without any issue even when 100 sheets were continuously passed. In contrast, when 100 sheets of paper type B, such as thin paper, were continuously passed, an image defect in which streak-like marks were formed in the image occurred in addition to an image defect in which wrinkles were generated in the recording medium P. Furthermore, when paper type C, such as glossy paper, was used, glossy unevenness occurred on the left and right sides of the image.

In contrast, according to the fixing device A of the present embodiment, excellent images were obtained for all the paper types. Since the paper type B is thin paper, the stiffness of the paper is low and, thus, the paper is easily influenced by deformation of the fixing film 1 during conveyance of the recording medium P. According to Comparative Example 1, the rotation of the fixing film 1 is not stable due to the above-mentioned alignment deviation, and the unstable rotation causes difference in the conveyance performance between the left and right portions, resulting in wrinkles of the paper. For this reason, the image rubs against the conveyance unit in the image forming apparatus, generating the streak-like marks in the image. In addition, according to Comparative Example 1, there is a difference in pressure distribution between both ends of the fixing nip portion N in the Y-axis direction, and a difference in fixability occurs between the left and right sides of the image. As a result, the glossy unevenness occurs on highly glossy paper, such as paper type C.

As described above, the fixing device A includes the guide 9 that is pivotable relative to the stay 10 about a shaft that is substantially perpendicular to the fixing nip portion N and that serves as a pivot point. Then, the guide 9 is pivoted by the force received from the fixing film 1 when the fixing film 1 slides on the guide 9, and the alignment with respect to the stay 10 is corrected. In this way, the fixing device A in which the fixing film 1 rotates stably can be provided.

In the above description, the surface profiles and the like of the guide 9 and the stay 10 are not particularly specified.

However, a configuration may be employed in which the frictional force (the friction coefficient) between the fixing film 1 and the guide 9 is less than the frictional force (the friction coefficient) between the guide 9 and the stay 10 by adjusting, for example, the materials, surface profiles, surface roughness, contact area, and the like of the guide 9 and the stay 10. Alternatively, a configuration may be employed in which a lubricant (e.g., grease or oil) is applied between the guide 9 and the stay 10 to adjust the frictional force, in addition to the optimization of the profiles and the materials. The configurations allow the guide 9 to pivot about the protrusion S serving as the pivot point more easily due to the force received from the fixing film 1 on the basis of the rotation of the fixing film 1. Thus, the alignment deviation can be appropriately corrected.

Furthermore, the configuration in which the contact area between the guide 9 and the stay 10 is reduced can additionally prevent heat transfer from the guide 9 to the stay 10, so that heat transfer to a member other than the recording medium P can be reduced and, thus, the power consumption can be reduced more.

While the present embodiment has been described with reference to the configuration in which the guide 9 is provided with the protrusion S that fits into the opening of the stay 10, a configuration may be employed in which the stay 10 is provided with the protrusion S and the guide 9 is provided with a recess. That is, it is only required that a protrusion serving as a pivot point is provided on one of the guide 9 and the stay 10, and an opening or a recess for receiving the protrusion is provided on the other. Alternatively, a configuration may be employed in which another member is combined to rotatably support the guide 9. Still alternatively, a configuration may be employed in which the guide 9 is movably supported in a direction in which alignment deviation is corrected by a movement other than pivotal movement.

Second Embodiment

According to the present embodiment, the shape of a guide differs from that according to the first embodiment. More specifically, the surface forming the fixing nip portion N is not a flat surface, but a curved shape having a portion PP protruding toward the pressure roller 7 so that the pressure distribution of the fixing nip portion N in the recording medium conveyance direction (the X-axis direction) is larger on the downstream side than on the upstream side of the center of the fixing nip portion N. The shape can improve the toner fixing performance. In addition, toner can be fixed at a lower temperature and, thus, the power consumption can be reduced.

Figure 6A:
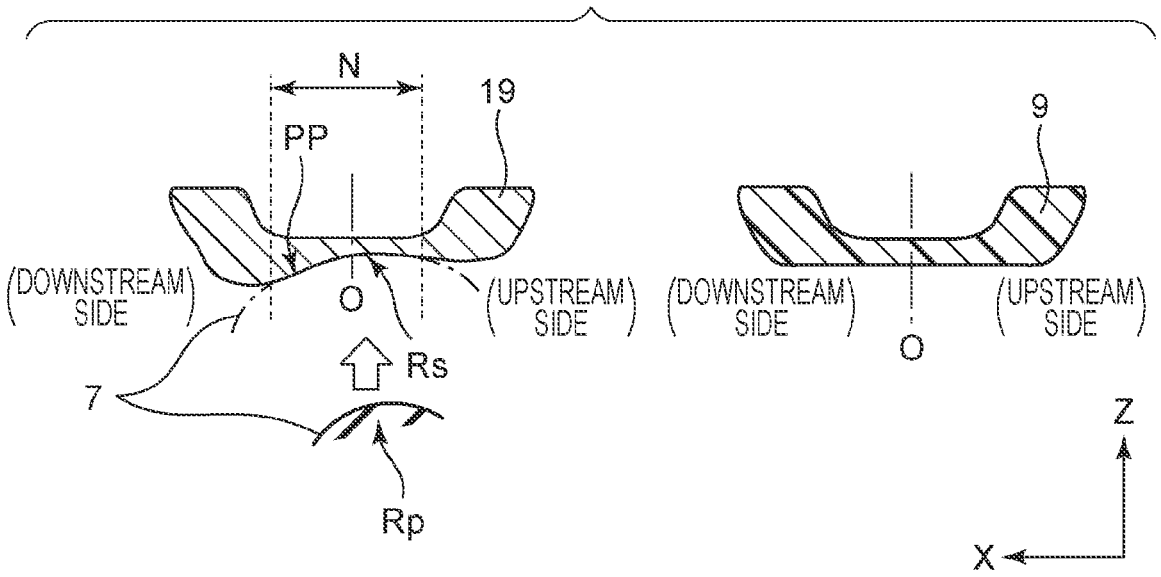
FIGS. 6A and 6B are a cross-sectional view and the pressure distribution diagram of a guide of a fixing device, respectively, according to a second embodiment.
Figure 6B:
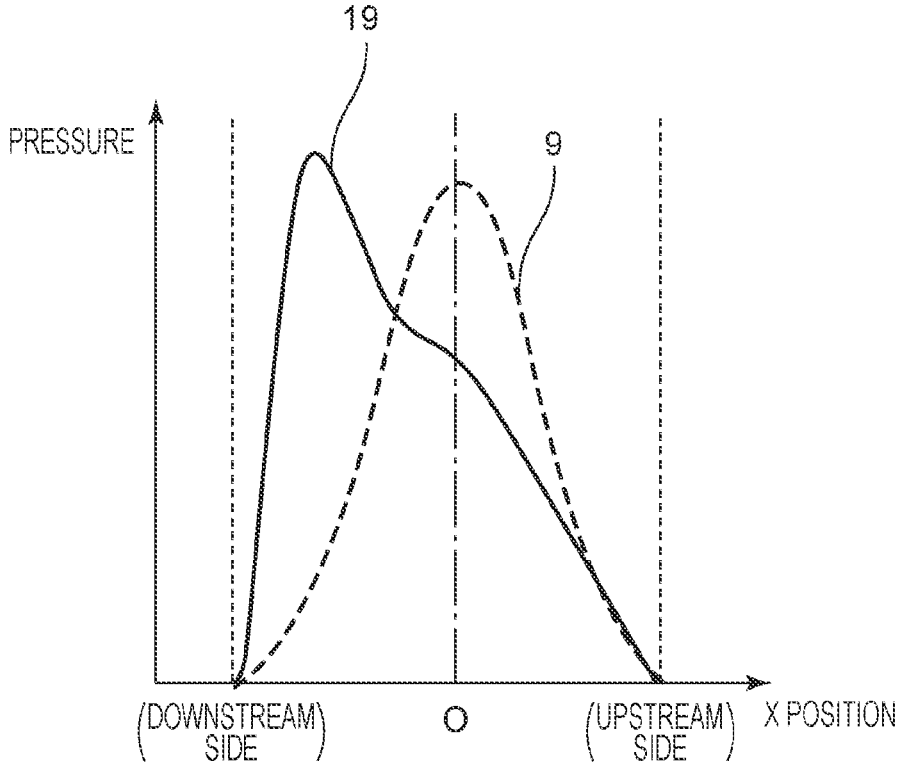

FIG. 6A illustrates the cross-sectional shape of a guide 19 according to the second embodiment, which is a replacement of the guide 9 according to the first embodiment. FIG. 6B illustrates the pressure distribution in the fixing nip portion N according to the second embodiment. For comparison purposes, the cross-sectional shape and pressure distribution of the guide 9 used in the first embodiment are also illustrated. The point O illustrated in FIGS. 6A and 6B represents the central part in the nip width direction. The surface on which the fixing film 1 of the guide 19 according to the second embodiment slides is a curved surface having a radius of curvature of Rs. As illustrated in FIG. 6A, when the pressure roller 7 is pressed against the guide 19 according to the second embodiment via the fixing film 1, the pressure roller 7 has the shape outlined by an alternate long and short dash line, and the fixing nip portion N is formed. Note that let Rp denote the radius of the pressure roller 7. Then, $Rs \geq Rp$.

When the guide 9 according to the first embodiment is used, the shape of the surface forming the fixing nip portion N is flat, so that the pressure distribution of the fixing nip portion N on the upstream side and the pressure distribution of the fixing nip portion N on the downstream side are symmetrical with respect to the point O at which the pressure peak occurs. In contrast, when the guide 19 according to the second embodiment is used, the pressure peak occurs on the downstream side of the point O.

Figure 7A:
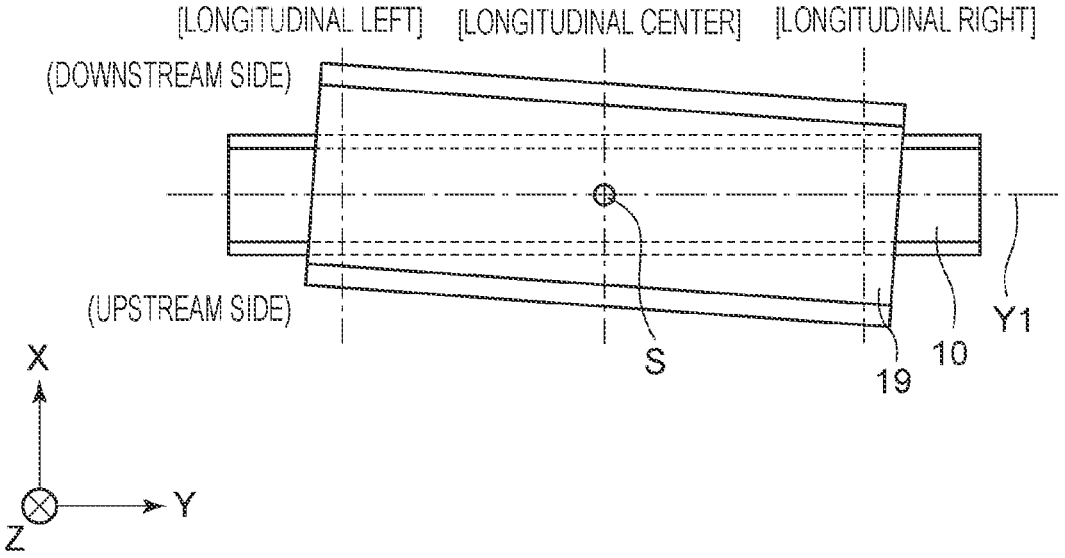
FIGS. 7A and 7B illustrate the difference in pressure distribution.
Figure 7B:
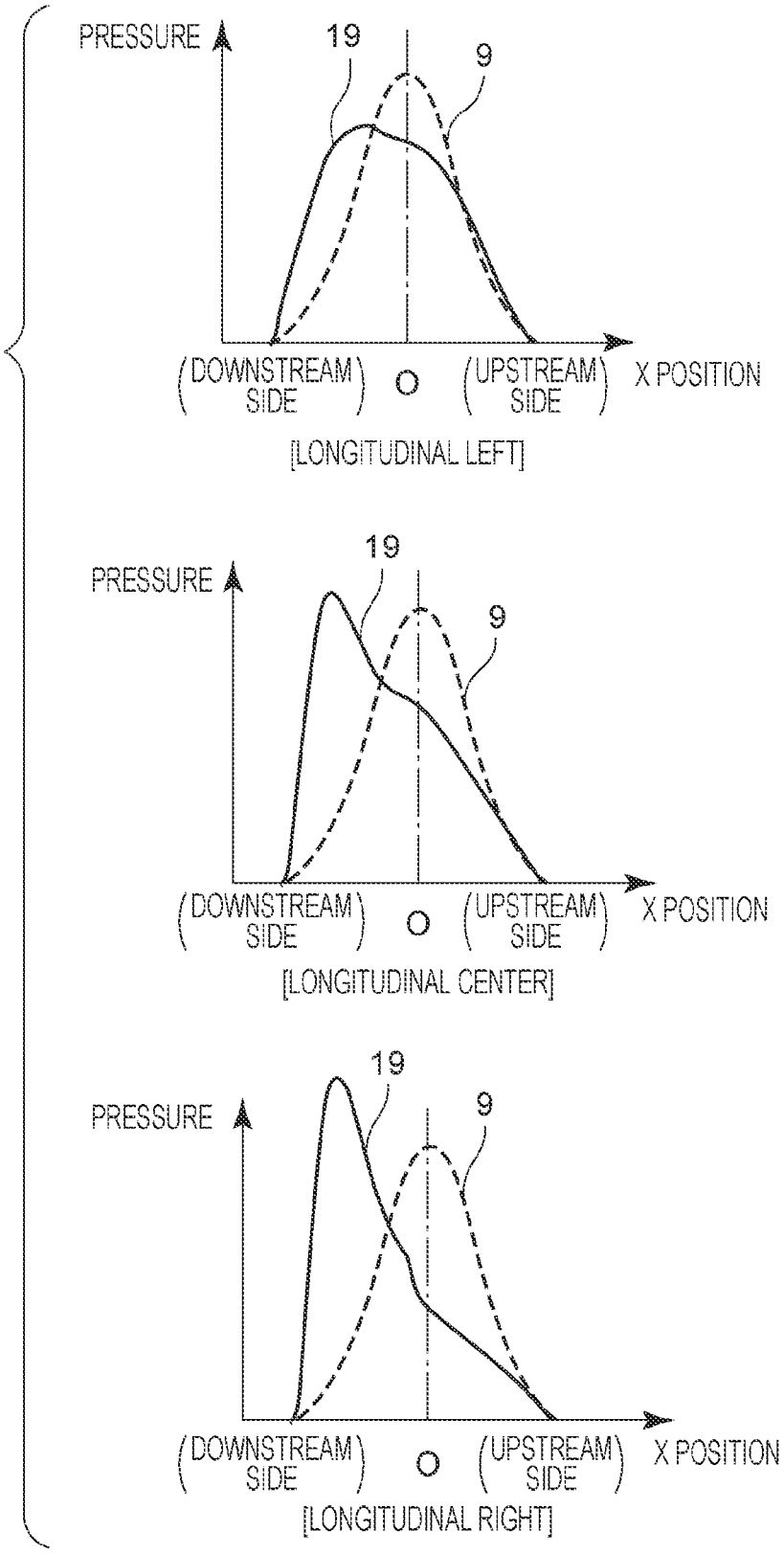

For illustrative purposes, FIGS. 7A and 7B illustrate the pressure distribution of the fixing nip portion N in each of a "longitudinal center" portion, a "longitudinal left" portion, and a "longitudinal right" portion in the Y-axis direction (the longitudinal direction of the fixing device A) when the guide 19 having deviated alignment is fixed.

In the situation illustrated in FIG. 7A, in the "longitudinal left" portion, the pressure peak part on the downstream side in the conveyance direction of the recording medium P is less than the pressure peak part in the "longitudinal center" portion. In contrast, in the "longitudinal right" portion, the pressure peak part on the downstream side is greater than the pressure peak part in the "longitudinal center" portion. This is because in the "longitudinal right" portion, the portion PP bites into the nip center portion in the conveyance direction, while in the "longitudinal left" portion, the portion PP is out of the region of the fixing nip portion N due to the alignment deviation.

However, when like the guide 9, the guide surface is flat and, thus, pressure peak is positioned in the central part in the conveyance direction, the part corresponding to the peak is unlikely to be out of the fixing nip portion N even if the alignment deviation occurs.

For this reason, the difference between the pressure distributions at both ends in the Y-axis direction is small and, thus, the influence of the alignment deviation is little. As described above, the configuration in which the peak value of the pressure distribution is deviated from the center of the fixing nip portion N in the conveyance direction, the peak part may deviate from the region of the fixing nip portion N due to the alignment deviation. As a result, the pressure distribution tends to be different on the right and left in the longitudinal direction. If the pressure distribution is different on the right and left in the longitudinal direction, uneven fixing of a toner image occurs.

In contrast, since the guide 19 according to the second embodiment is provided in a pivotable manner relative to the stay 10 about the protrusion S serving as a pivot point, the alignment is corrected, and the pressure distribution can be uniform throughout the length of the fixing device A in the longitudinal direction. As a result, an excellent image with uniform fixability can be obtained.

Note that when the surface continuously connected to the portion PP of the guide 19 in the conveyance direction (the X-axis direction) is curved as illustrated in FIG. 6A and, in addition, the alignment correction mechanism as according to the present embodiment is provided, the alignment correction operation is likely to be automatically performed by just the pressure of the pressurizing springs 11*a* and 11*b*. This is because the curved surface shape of the guide 19 can easily follow the axial line of the pressure roller 7.

While the present embodiment has been described with reference to the protrusion S of the guide 19 located at the center of the fixing nip portion N in the X-axis direction, the protrusion S may be located upstream of the center of the fixing nip portion N in the X-axis direction. In this case, the frictional force caused by the rotation of the fixing film 1 acts on the guide 19 toward the downstream side in the conveyance direction of the recording medium P. Therefore, the guide 19 and the fixing film 1 tend to follow the rotation direction, and the rotation behavior is more stable. As a result, even if alignment deviation occurs, a correction is reliably performed. This also applies to the guide 9 according to the first embodiment.

Furthermore, by employing the configuration in which the position of the portion PP of the guide 19 forming the pressure peak differs from the position of the protrusion S serving as the pivot point in the X-axis direction, pivot of the guide 19 to correct the alignment is more smoothly performed. The reason is that, due to the relationship between the point of effect, the pivot point, and the point of action, a high frictional force caused by the sliding resistance acts on the portion PP away from the pivot point, so that the guide 19 is likely to pivot. The position of the pivot point may be set on the downstream side of the portion PP of the guide 19 in the conveyance direction. Alternatively, the position of the pivot point may be set to the position of the guide 19 corresponding to a position outside of the fixing nip portion N in the conveyance direction.

Alternatively, by employing a configuration in which the surface of the guide forming the fixing nip portion N is a flat surface and, in addition, the center of the guide in the X-axis direction is offset into or inclined to the upstream side of the core metal 7*a* of the pressure roller 7 in the conveyance direction, the pressure distribution peak can be formed on the downstream side inside of the fixing nip portion N. Even in this case, the alignment can be corrected by making the guide pivotable.

The above first and second embodiments have been described with reference to the fixing device A having a configuration in which the fixing film 1 is heated by electromagnetic induction. However, the alignment correction mechanism according to the first or second embodiment may be applied to a fixing device in which a plate-shaped heater is in contact with the inner surface of the fixing film and, in addition, the fixing nip portion N consists of the heater and a pressure roller via a fixing film. It is only required that a heater holder (a film guide) that holds the heater pivots as in the first and second embodiments.

Still alternatively, the alignment correction mechanism according to the first or second embodiment may be applied to a fixing device in which a halogen heater is disposed in the internal space of the fixing film and, in addition, the fixing film is heated by the radiation heat of the halogen heater.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-094998 filed Jun. 7, 2021, which is hereby incorporated by reference herein in its entirety.

What is claimed is:

1. A fixing device configured to fix a toner image formed on a recording medium to the recording medium, the fixing device comprising:

a rotating member that is flexible and cylindrical;

a guide member disposed in an internal space of the rotating member throughout a length of the rotating member in a longitudinal direction of the rotating member so as to be in contact with an inner surface of the rotating member and configured to guide rotation of the rotating member;

a holding member disposed in the internal space of the rotating member throughout the length of the rotating member in the longitudinal direction of the rotating member and configured to hold the guide member throughout a length of the guide member in the longitudinal direction; and a roller configured to contact with an outer surface of the rotating member and to form a fixing nip portion together with the guide member between the rotating member and the roller, wherein the fixing device fixes the toner image formed on the recording medium to the recording medium while pinching and conveying the recording medium in the fixing nip portion, wherein the guide member is pivotable relative to the holding member about a pivot point that is a shaft substantially perpendicular to a surface of the fixing nip portion, and wherein, when the rotating member slides on the guide member, the guide member pivots due to a force received from the rotating member so that alignment of the guide member with respect to the holding member is corrected.

2. The fixing device according to claim 1, wherein a protrusion configured to serve as the pivot point is provided on one of the guide member and the holding member, and an opening or a recess configured to mate with the protrusion is formed in the other of the guide member and the holding member.

3. The fixing device according to claim 1, wherein the holding member is a metal stay configured to reinforce the guide member.

4. The fixing device according to claim 1, wherein a shape of a surface of the guide member that forms the fixing nip portion is a curved surface having a portion protruding toward the roller so that a pressure distribution of the fixing nip portion on a downstream side of a center of the fixing nip portion in a recording medium conveyance direction is larger than a pressure distribution of the fixing nip portion on an upstream side.

5. The fixing device according to claim 4, wherein a relationship $Rs \geq Rp$ is satisfied, where Rs represents a radius of curvature of the portion of the curved surface of the guide member, and Rp represents a radius of the roller.

6. The fixing device according to claim 1, wherein the rotating member includes a heat generating layer configured to heat the toner image by providing heat from the heat generating layer.

7. The fixing device according to claim 6, further comprising an energizing coil configured to heat the heat generating layer by electromagnetic induction.

8. The fixing device according to claim 7, further comprising a magnetic core disposed in an internal space of the energizing coil and configured to guide lines of magnetic force generated when a high-frequency current is passed through the energizing coil, wherein a helical axis of the energizing coil is parallel to a generatrix direction of the rotating member, wherein the magnetic core has an ended shape in a direction of the helical axis, and wherein the lines of magnetic force emitted from one end of the magnetic core pass through an outside of the rotating member and enter the other end so that a current flowing in a circumferential direction of the rotating member is induced in the heat generating layer.

9. A fixing device configured to fix a toner image formed on a recording medium to the recording medium, the fixing device comprising:

a rotating member that is flexible and cylindrical;

a guide member disposed in an internal space of the rotating member throughout a length of the rotating member in a longitudinal direction of the rotating member so as to be in contact with an inner surface of the rotating member and configured to guide rotation of the rotating member;

a holding member disposed in the internal space of the rotating member throughout the length of the rotating member in the longitudinal direction of the rotating member and configured to hold the guide member throughout a length of the guide member in the longitudinal direction; and a roller configured to form a fixing nip portion together with the guide member via the rotating member, wherein the fixing device fixes the toner image formed on the recording medium to the recording medium while pinching and conveying the recording medium in the fixing nip portion, wherein to allow the guide member to pivot relative to the holding member about a shaft, a protrusion corresponding to the shaft is provided on one of the guide member and the holding member, and an opening or a recess into which the protrusion fits is provided in the other, and wherein, when the rotating member slides on the guide member, the guide member pivots about the shaft due to a force received from the rotating member so that alignment of the guide member with respect to the holding member is corrected.

10. The fixing device according to claim 9, wherein the holding member is a metal stay configured to reinforce the guide member.

11. The fixing device according to claim 9, wherein a shape of a surface of the guide member that forms the fixing nip portion is a curved surface having a portion protruding toward the roller so that a pressure distribution of the fixing nip portion on a downstream side of a center of the fixing nip portion in a recording medium conveyance direction is larger than a pressure distribution of the fixing nip portion on an upstream side.

12. The fixing device according to claim 11, wherein a relationship $Rs \geq Rp$ is satisfied, where Rs represents a radius of curvature of the portion of the curved surface of the guide member, and Rp represents a radius of the roller.

13. The fixing device according to claim 9, wherein the rotating member includes a heat generating layer configured to heat the toner image by providing heat from the heat generating layer.

14. The fixing device according to claim 13, further comprising an energizing coil configured to heat the heat generating layer by electromagnetic induction.

15. The fixing device according to claim 14, further comprising a magnetic core disposed in an internal space of the energizing coil and configured to guide lines of magnetic force generated when a high-frequency current is passed through the energizing coil, wherein a helical axis of the energizing coil is parallel to a generatrix direction of the rotating member, wherein the magnetic core has an ended shape in a direction of the helical axis, and wherein the lines of magnetic force emitted from one end of the magnetic core pass through an outside of the rotating member and enter the other end so that a current flowing in a circumferential direction of the rotating member is induced in the heat generating layer.

* * * * *